US008820485B2

(12) United States Patent
Umbaugh

(10) Patent No.: US 8,820,485 B2
(45) Date of Patent: Sep. 2, 2014

(54) LOCKING SYSTEM FOR A LIFT DOOR

(75) Inventor: Barry K. Umbaugh, Gettysburg, PA (US)

(73) Assignee: Inventio AG, Hergiswil (CH)

( * ) Notice: Subject to any disclaimer, the term of this patent is extended or adjusted under 35 U.S.C. 154(b) by 482 days.

(21) Appl. No.: 12/809,437

(22) PCT Filed: Dec. 18, 2007

(86) PCT No.: PCT/IS2007/025783

§ 371 (c)(1),
(2), (4) Date: Jun. 18, 2010

(87) PCT Pub. No.: WO2009/078837

PCT Pub. Date: Jun. 25, 2009

(65) Prior Publication Data

US 2011/0247376 A1 Oct. 13, 2011

(51) Int. Cl.
*B66B 13/26* (2006.01)
*B66B 13/12* (2006.01)
*B66B 13/16* (2006.01)

(52) U.S. Cl.
CPC ..... *B66B 13/165* (2013.01); *B66B 13/16* (2013.01)
USPC ..... 187/317; 187/319; 187/330

(58) Field of Classification Search
CPC ..... B66B 13/16; B66B 13/18; B66B 3/12; B66B 13/26
USPC ..... 187/316, 317, 319, 330, 331, 335
See application file for complete search history.

(56) References Cited

U.S. PATENT DOCUMENTS

| | | | | |
|---|---|---|---|---|
| 1,955,303 | A * | 4/1934 | Lewis | 187/280 |
| 4,934,488 | A * | 6/1990 | Umemura | 187/335 |
| 4,947,964 | A * | 8/1990 | Husmann | 187/319 |
| 5,377,785 | A * | 1/1995 | Pearson | 187/308 |
| 6,328,133 | B1 * | 12/2001 | Kim | 187/319 |

(Continued)

FOREIGN PATENT DOCUMENTS

| | | | |
|---|---|---|---|
| EP | 1 541 517 A1 | 6/2005 | |
| EP | 1 266 860 B1 | 2/2010 | |
| JP | 04055284 A * | 2/1992 | B66B 13/26 |

OTHER PUBLICATIONS

JP04-055284 English Translation.*

(Continued)

*Primary Examiner* — William E Dondero
*Assistant Examiner* — Minh Truong
(74) *Attorney, Agent, or Firm* — Buchanan Ingersoll & Rooney PC

(57) ABSTRACT

A locking system for a lift door, in particular a car door of a lift car and/or a shaft door, comprises a locking device which in an unlocked state enables opening of the lift door, and in a locked state restricts, in particular prevents opening of the lift door; a reference element; a counter element which interacts with the reference element, in particular mechanically, electrically, magnetically, acoustically and/or optically, in a prescribed measure when the lift car is located in a permissible position relative to a shaft door; a sensor for outputting a preferably electrical signal when the reference element and the counter element are interacting with one another; and a control device for transferring the locking device from the locked state into the unlocked state as a function of the signal, the reference element preferably being arranged on the shaft door.

23 Claims, 5 Drawing Sheets

(56) References Cited

U.S. PATENT DOCUMENTS

| | | | | |
|---|---|---|---|---|
| 6,382,362 | B1 * | 5/2002 | Kutz | 187/316 |
| 6,591,946 | B2 * | 7/2003 | Lauch | 187/309 |
| 7,140,470 | B2 * | 11/2006 | Azpitarte | 187/317 |
| 7,156,210 | B2 * | 1/2007 | Reynolds et al. | 187/317 |
| 2005/0087401 | A1 * | 4/2005 | Kuipers et al. | 187/316 |
| 2005/0139429 | A1 | 6/2005 | Bisang et al. | |
| 2005/0156738 | A1 * | 7/2005 | Grimshaw | 340/565 |
| 2006/0064267 | A1 * | 3/2006 | Sugiura | 702/117 |
| 2006/0157305 | A1 | 7/2006 | DePlazes et al. | |

OTHER PUBLICATIONS

International Search Report (PCT/ISA/210) dated Jul. 22, 2008.

* cited by examiner 151
152
20
100
200
300
400
500

LOCKING SYSTEM FOR A LIFT DOOR

The present invention relates to a locking system for a lift door, in particular for a car door of a lift car, and/or a shaft door, in the case of which locking system an interaction between a reference element and a counter element which is dependent on the position of the lift car is a condition for the unlocking of the lift door.

If a car door of a lift car which can be moved in a shaft between a number of shaft doors is opened when the lift car is not located at a floor level, there is the risk of lift passengers coming between the lift car and the shaft wall and thereby being injured. If the passengers also open the shaft doors, there is the risk of plunging into the shaft. Consequently, there are known from EP 1 541 517 A1, for example, mechanical locking systems in which driver skids on the car door can be moved against coupling rollers on a shaft door in order to open car door and shaft door jointly, a driver skid mechanically unlocking a locking device which, in a locked state, prevents opening of the car door, when it strikes the coupling rollers. However, this solution is mechanically complicated.

It is therefore an object of the present invention to specify an improved locking system for a lift door of a lift car.

This object is achieved by means of a locking system, which includes a locking device which in an unlocked state enables opening of the lift door, and in a locked state restricts opening of the lift door; a reference element; a counter element which is provided for the purpose of entering into interaction with the reference element when at least a condition is fulfilled that the lift car is located in a permissible position relative to a shaft door; a sensor which outputs a signal when the reference element and the counter element have entered into interaction; and a control device which transfers the locking device from the locked state into the unlocked state as a function of the signal, and by a locking system, which includes a bistable locking device which in a stable unlocked state enables opening of the lift door, and in a stable locked state restricts opening of the lift door; a reference element; a counter element which is provided for entering into interaction with the reference element when at least a condition is fulfilled that the lift car is located in a permissible position relative to a shaft door; a sensor which outputs a signal when the reference element and the counter element have entered into interaction; and a control device which transfers the locking device from the locked state into the unlocked state as a function of the signal, the control device comprising: a first switch which is switched into a presence state when the reference element and the counter element have entered into interaction, and into an absence state when said interaction is not present, and a second switch which is switched into a lock state when the locking device is transferred into the locked state, and is switched into an unlock state when the locking device is transferred into the unlocked state; such that the locking device upon being supplied with energy will transfer into the unlocked state as long as the first switch is in the presence state and the second switch in the lock state, and the locking device upon being supplied with energy will transfer into the locked state as long as the first switch is in the absence state and the second switch in the unlock state. In accordance with an exemplary embodiment, a lift having a lift car which can be moved in a shaft, at least one car door, at least one shaft door and a locking system as disclosed herein. Advantageous developments are the subject matter of the sub claims.

A substantial advantage of the locking system according to the invention consists in the fact that instead of a complicated unlocking mechanism there is present a simple control device which uses an actuator to transfer the locking device from the locked state into the unlocked state when the preconditions for unlocking are fulfilled at a floor stop of the lift car.

According to a first design of the present invention, a locking system for a car door of a lift car comprises a locking device which in an unlocked state enables opening of the car door in a manual or mechanical fashion, and in a locked state restricts, in particular prevents opening of the car door. The present invention is explained in more detail below using the example of a locking system for a car door. In the same way, it is also possible in addition or as an alternative to lock a shaft door of the lift. In addition or as an alternative, in this case the locking device can also restrict, in particular prevent opening of the shaft door.

The locking device advantageously restricts opening of the car door at least to a certain extent that a lift user cannot leave the lift car in a dangerous situation. The locking device can permit opening to a specific, restricted extent in order, for example, to facilitate the exchange of air or communication between the car interior and the surroundings. The locking device can likewise also completely prevent opening of the car door.

The locking system further comprises a control device for transferring the locking device from the locked into the unlocked state, and vice versa. In this case, the control device transfers the locking device from the locked into the unlocked state as a function of a preferably electrical signal which a sensor outputs when a reference element and a counter element have entered into interaction with one another to a prescribed extent. Transferral from the unlocked into the locked state can likewise be performed actively by the control device, or passively by elastic elements pretensioned upon unlocking, or the like.

As explained in more detail below, interaction between reference element and counter element can, for example, be mechanical, in which case the reference element exerts a specific force on the counter element or moves the counter element by a prescribed distance. The term "force" in this case also covers a pressure exerted on the counter element. Likewise, reference element and counter element can, for example, also enter into interaction with one another electrically, in particular inductively or magnetically, in which case the reference element or the counter element effects in the respective other element an electrical voltage or a magnetic field of specific strength. Reference element and counter element can also enter into interaction with one another acoustically or optically, in which case the reference element or the counter element detects sound waves, in particular in the audible range or in the ultrasound range, or electromagnetic waves, in particular in the region of visible light, in the ultraviolet or infrared regions, which are emitted or reflected by the respective other element.

Reference element and counter element are tuned to one another in this case such that their interaction lies in a prescribed region whenever the lift car is located in a permissible position relative to a shaft door. Such a permissible position can, in particular, be a position in which a vertical spacing between the floor of the lift car and the surface of a floor which can be accessed on foot through the shaft door does not overshoot a prescribed maximum value such that it is possible to enter or exit the lift car through the shaft door without danger.

The counter element is preferably arranged on the lift car, in particular the car door to be locked.

In a preferred embodiment of the locking system according to the invention, the reference element is arranged on the shaft door itself, which is opposite the car door to be locked, when the lift car is located in a permissible position relative to the shaft door. If the car door to be locked can optionally be opposite various shaft doors on different floors, one reference element each can be arranged on a number of, preferably on all these shaft doors. On the one hand, this ensures, as in the known mechanical solutions, that the car door is unlocked only when it is located opposite a shaft door. The arrangement of the reference elements on the shaft doors has the advantage that they can already be mounted in the course of setting up and need not be mounted and aligned on each floor during installation of the lift. In addition, it is possible to reduce the risk of the counter element entering into interaction with an improper reference element, and thus of the car door being unlocked in an impermissible position of the lift car. In known solutions, in which the reference element is arranged on the shaft wall or on the guide rail, deposits of dirt or the like can erroneously interrupt or reflect light beams of a light barrier or a photosensor, or mechanically actuate a contact switch. Owing to the frequent movement of the shaft doors in lift operation, the risk of such deposits, which inadvertently act as reference element, is less when the reference element is arranged on the shaft door itself.

In a particularly preferred embodiment of the present invention, the reference element, the counter element and the sensor are formed by components of a coupling device which couples the car door, provided with a door drive, to a currently opposite shaft door, in order to open and to close the car door and the shaft door jointly. In the case of lifts, such preferably mechanical coupling devices are frequently present in order to save drive mechanisms for the shaft doors. In the preferred embodiment, elements of these coupling devices, present in any case, are therefore advantageously used at the same time as reference element and counter element, respectively. It is thereby possible to reduce the outlay on equipping or reequipping a lift with a locking system according to the invention and, in particular, reduce the number of parts required.

In particular, the coupling device can comprise a driver skid which can be moved for coupling purposes against a coupling roller present on the shaft door. In this case, the coupling roller can function as the reference element, while the driver skid comprises the counter element. In this arrangement, reference element and counter element are then advantageously brought into interaction with one another by the coupling device only when the driver skid is moved for coupling purposes against the reference element arranged on the shaft door. An interaction, in particular mechanical wear, upon passing by closed shaft doors without a floor stop, is thereby reduced or prevented in a simple way. As in the case of the known purely mechanical locking systems, in the case of this advantageous design the locking device is unlocked only when the driver skid is moved for coupling purposes against the reference element arranged on the shaft door, and in so doing enters into interaction therewith in the prescribed measure.

In a first variant of the advantageous design described above, the driver skid is of multipartite design and has a support skid in relation to which the counter element can move. The counter element can in this case preferably be fastened elastically on the support skid, and is moved during coupling by the reference element towards the support skid or away from the support skid. The sensor outputs the signal for transferring the locking device into the unlocked state when there is a spacing or a force between the support skid and the counter element in a prescribed range. Wear and the risk of damage to the sensor are advantageously reduced by this design, in which the sensor does not itself come into contact with the reference element.

Likewise, it is possible in a second variant of the above-described advantageous design to design a sensor surface of the sensor with the aid of which the latter detects the interaction on a contact surface, opposite the reference element, of the driver skid. The sensor then outputs an electrical signal when a spacing or a force is present between this contact surface and the reference element in the prescribed range. The design of the driver skid can thereby be simplified, and the interaction can be more directly detected.

As set forth above, the interaction, detected by the sensor, between reference element and counter element can, in particular, comprise a mechanical interaction, that is to say a force or a pressure between reference element and counter element. In order to detect this mechanical interaction, the sensor can comprise a force sensor which outputs the preferably electrical signal when a force acting between reference element and counter element lies in a prescribed range. Such a force sensor can, for example, as a diaphragm switch, comprise a piezosensor, a pressure-dependent resistor or a pressure-dependent capacitor, and be arranged, for example, on the contact surface, facing the reference element, of a driver skid between a support skid and a counter element which can be moved with respect to the latter, or in a pivot bearing between such a support skid and the counter element. In this arrangement, the force sensor can output the signal when a force detected by it or a pressure detected by it on its sensor surface overshoots a prescribed value, that is to say when the reference element and the counter element are pressed against one another with a minimum force.

Such a mechanical interaction can also be detected indirectly by a preferably contactless distance sensor, in particular an inductive, capacitive, optical and/or acoustic distance sensor, or by a magnetic reed sensor which detects a movement of the counter element, for example relative to a support skid, produced by interaction with the reference element.

However, a distance sensor can also be used to detect other interactions between reference element and counter element. Thus, the sensor can comprise a distance sensor, in particular a mechanical, inductive, capacitive, optical and/or acoustic distance sensor, or a magnetic reed sensor which outputs the signal when a spacing of the counter element from the reference element lies in a prescribed range. An inductive or capacitive distance sensor in this case detects an electrical interaction, a magnetic reed sensor detects a magnetic interaction, an optical sensor detects an optical interaction, and an acoustic sensor detects an acoustic interaction.

The sensor is preferably at least partially of flat, in particular of thin and flat design. This facilitates its arrangement in a coupling device, for example between counter element and support skid, or on the contact surface of the driver skid. The diaphragm switches already mentioned are, in particular, suitable for this purpose.

The measure of the interaction between reference element and counter element can be prescribed in such a way that the sensor outputs the signal when the interaction between reference element and counter element undershoots or overshoots a prescribed limiting value. Thus, the sensor can, for example, output the preferably electrical signal when a force exerted by the reference element on the counter element, or a force between support skid and counter element pressed thereagainst overshoots a maximum value, or a spacing between the support skid and the counter element pressed thereagainst undershoots a specific minimum value. Maximum and minimum values can in this case advantageously be selected such that random interactions, for example owing to dirt deposits touched by the counter element, or to inertial forces, do not lead to the signal being output.

The control device can comprise an electrical switch which is switched over directly or indirectly by the signal output by the sensor. In particular, the counter element itself can close or open an electrical circuit and thus function as a switch to be switched over directly. This simplifies the control device and raises its fault tolerance and fail safety. Likewise, an electrical switch which transfers the locking device from the locked into the unlocked state can also be switched over indirectly, for example by a microprocessor, a lift controller or car controller, or the like. This renders it possible, in particular, to carry out further steps before, during or after transfer into the unlocked state, for example in order to check how long the signal has been output, whether signals have been output by a number of sensors, or the like.

The control device can advantageously also be actuated by remote control. In this case, it transfers the locking device from the locked into the unlocked state when it receives a corresponding remote control signal, for example a radio signal. This facilitates maintenance, evacuation and the like.

The locking device preferably has a bistable, in particular an electromagnetically actuated bistable bolt for locking the car door such that the locking device remains stable, that is to say without being fed energy, both in the unlocked and in the locked state. Such a bistable bolt can be embodied, for example, by means of a bistable, electromagnetically actuated solenoid 300 (See FIGS. 1A and 5A-5D). Likewise, the stabilization of the locked and unlocked states can also be accomplished in another way, in particular mechanically, for example by means of spring latching elements acting on the bolt in the end positions thereof. Owing to such a bistable bolt, energy, in particular electrical energy, is advantageously required only for transferring from the locked into the unlocked state, and vice versa. The low energy requirement achieved thereby is advantageous, in particular, when a switchover is made to battery feed in the event of power failure. A bistable bolt, or a bolt actuated by a bistable actuator, furthermore ensures that, even in the event of failure of an energy supply, the locked or unlocked state assumed at the instant of power failure is maintained.

In order to implement a bistable locking device which can be transferred by an electrical signal from the unlocked into the locked state, or from the locked into the unlocked state, according to a second design of the present invention, which can be combined with one or more features of the above-described first design, a locking system for a car door of a lift car has a bistable locking device which in a stable unlocked state enables opening of the car door, and in a stable locked state restricts, in particular prevents opening of the car door. A control device transfers the locking device from one to the respective other state as a function of a preferably electrical signal which specifies whether the lift car is located in a permissible position relative to a shaft door and, consequently, a reference element and a counter element are interacting with one another or not, in particular mechanically, electrically, magnetically, acoustically and/or optically in a prescribed measure.

The control device comprises a first switch which is switched into a presence state when reference element and counter element have entered into interaction with one another in the prescribed measure, and into an absence state when reference element and counter element are not interacting with one another in the prescribed measure and a second switch which is switched into a lock state when the locking device is transferred into the locked state, and is switched into an unlock state when the locking device is transferred into the unlocked state. The locking device is supplied with energy for transferral into the unlocked state as long as the first switch is in the presence state and the second switch in the lock state, and it is supplied with energy for transferral into the locked state as long as the first switch is in the absence state and the second switch in the unlock state.

If the lift car with locked car door reaches a permissible position relative to the shaft door, a sensor detects that a reference element and the counter element are interacting with one another in the prescribed measure. Consequently, the first switch is switched into the presence state. Since, because of the still locked car door, the second switch is still located in the lock state, the locking device is now supplied with energy for transferral into the unlocked state.

As soon as the locking device is transferred into the unlocked state, the second switch is switched into the unlock state and the locking device is no longer supplied with energy.

If the sensor detects that reference element and counter element are no longer interacting with one another in the prescribed measure, the first switch is switched into the absence state. Since, because of the unlocked car door, the second switch is still located in the unlock state, the locking device is now supplied with energy for transferral into the unlocked state.

As soon as the locking device is transferred into the locked state, the second switch is switched into the lock state, and the locking device is no longer supplied with energy.

A bistable locking device is thereby implemented in a simple, reliable way.

Further advantages and features follow from the subclaims and the exemplary embodiments. To this end, in a partially schematic fashion:

FIGS. 1A, 1B show a part of a lift car with a car door and a locking system according to a design of the present invention. FIG. 1A shows the closed car door, locked by a locking device, and FIG. 1B shows the unlocked and partially open car door;

FIGS. 2A, 2B show a coupling device, forming a part of the locking system from FIG. 1, for transferring the door movements from a car door to a shaft door. FIG. 2A shows the coupling device in the decoupled state, which effects the transfer of the locking device into its locked state, and FIG. 2B shows the coupling device in the coupling state in which the transfer of the locking device into its locked state is effected;

Figure 1A:
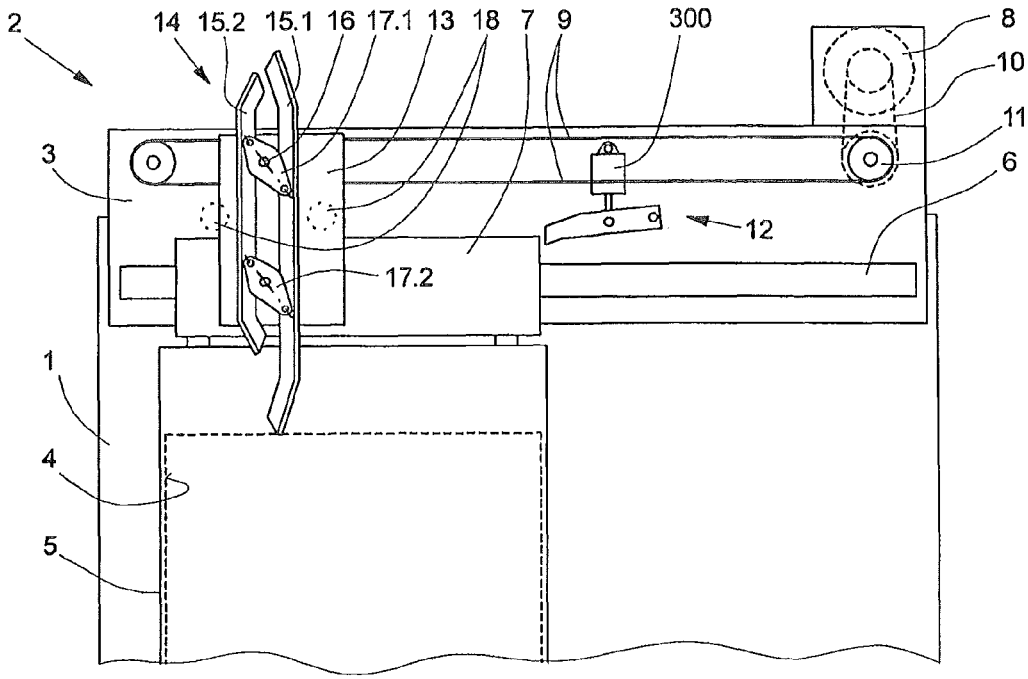
Figure 1B:
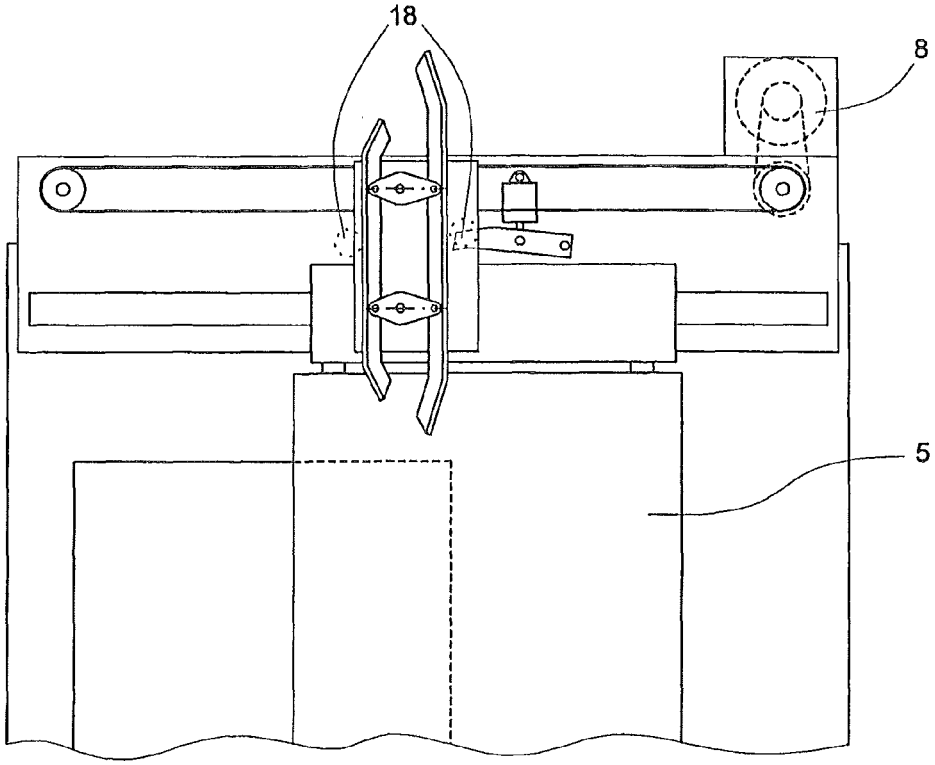

FIGS. 1A, 1B show a lift car 1 with a lift door drive device 2 and a door opening 4 which can be sealed by a laterally closing single-leaf door 5. The lift door drive device 2 is constructed on a door support 3 fastened on the lift car 1. The car door 5 is fastened on a suspension carriage 7 which can be displaced sideways along a guide rail 6 fixed on the door support, and is moved by a drive unit 8 between a door open position and a door closed position via a linearly acting, circulating drive means 9.

Fastened on the suspension carriage 7 is a base plate 13 on which a coupling device 14 for transferring the movement of the car door to one of these assigned shaft doors (not visible) is constructed. The coupling device 14 comprises two driver skids 15.1, 15.2 which are aligned parallel to the direction of motion of the lift car and are supported on two adjusting elements 17.1, 17.2 which can pivot about one pivoting axis 16 each, and can be displaced as regards their mutual separation by pivoting these adjusting elements, that is to say they can assume an unspread or a spread position.

The reference numeral 12 designates a locking device which can be switched over by an actuator in the form of a solenoid from a locked state, illustrated in FIG. 1A, into an unlocked state shown in FIG. 1B, and vice versa.

Present respectively on the shaft door leaves of all the doors of the floors are two coupling rollers 18 which project so far into the shaft space next to the driver skids 15.1, 15.2 that, in the spread state, the latter can transfer laterally directed forces and movements to the coupling elements 18 and the corresponding shaft doors, when the lift car 1 is located in the region of a floor level. The shaft doors assigned to the car door 5 illustrated are not visible for reasons of clarity, and the coupling elements 18 fitted on the shaft doors are illustrated only by means of phantom lines. The coupling roller 18 on the right in FIGS. 1-4 functions as reference element.

Pivoting the adjusting elements 17.1, 17.2, and thus adjusting the spacing between the driver skids 15.1, 15.2 is likewise performed by the drive unit 8 via the linearly acting drive means 9.

FIG. 1A shows the position of the coupling device 14 during a journey of the lift car 1, that is to say with the car door 5 locked by the locking device 12. In this situation, the driver skids 15.1, 15.2 assume their decoupling position (unspread position), in which they can move through in a vertical direction between the coupling rollers 18 fitted next to one another on the shaft doors.

FIG. 1B shows the situation in which the lift car 1 is located at the level of a floor opposite a shaft door, and the driver skids 15.1, 15.2 have been spread (coupling position) such that the latter have come into contact with the two coupling rollers 18 on the shaft door and, in cooperation with these coupling rollers 18, form a coupling between the car door 5 and the assigned shaft door which is free from backlash. In the situation illustrated, the locking device 12 assumes its unlocked state, and the drive unit 8 has already partially opened the car door 5 and, with it, also the assigned shaft door.

At the start of the door opening process, the car door is unlocked by the action of the right-hand driver skid 15.1 on the right-hand coupling roller 18, which functions as reference element.

Figure 2B:
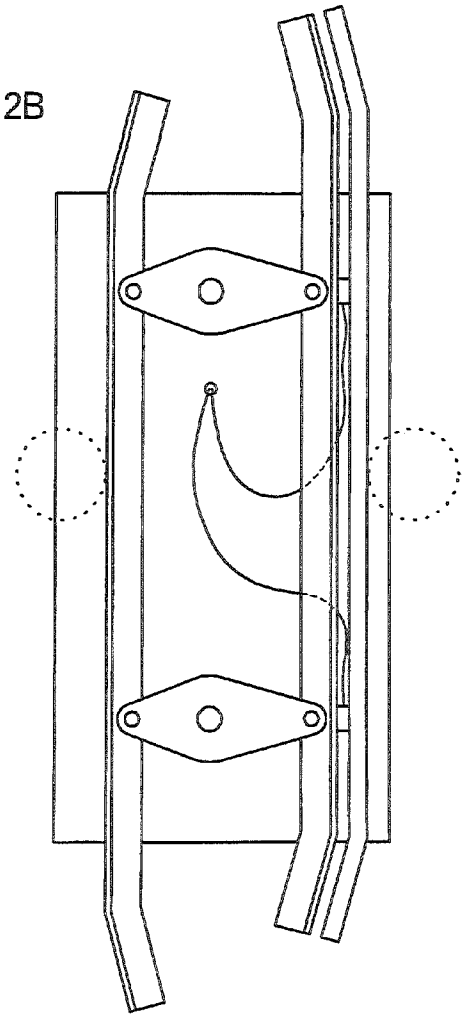
Figure 2A:
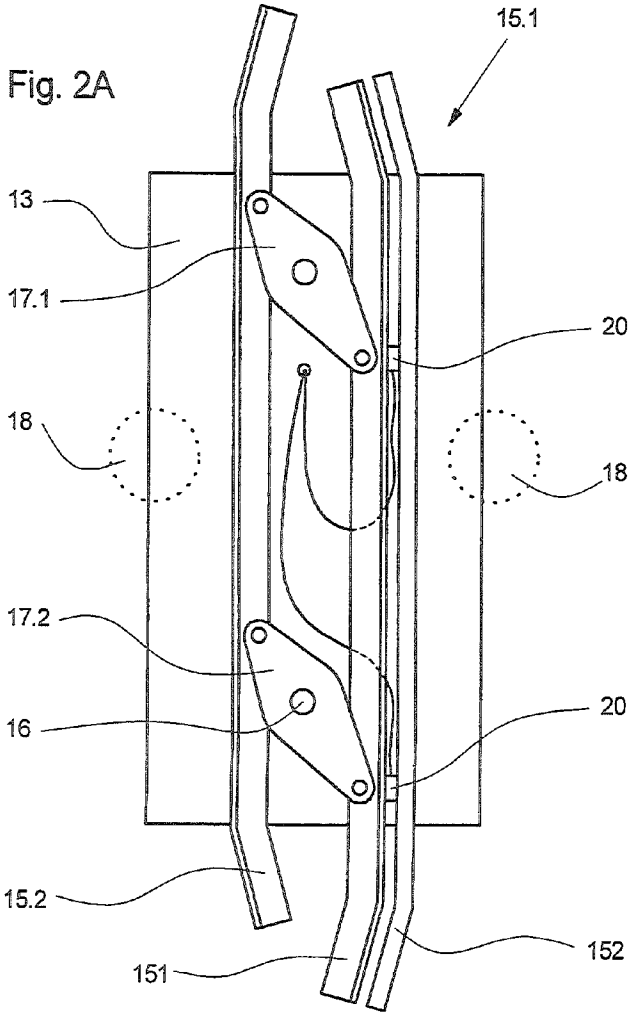

As illustrated in FIGS. 2A, 2B, to this end the right-hand driver skid 15.1 is designed in two parts with a support skid 151 and a counter element 152 connected to the latter via piezo force sensors 20. The support skid 151 and the left-hand driver skid 15.2 are drawn by the adjusting elements 17.1, 17.2 into the decoupling or unspread position shown in FIG. 2A such that they pass without making contact between the coupling rollers 18 as long as the car door is not to be opened.

If, in normal lift operation, the lift car has stopped in a permissible position opposite a shaft door, and if the aim is to open the car door and the opposite shaft door, the support skid 151 and left-hand driver skid 15.2 are spread by the adjusting elements 17.1, 17.2 into the coupling position shown in FIG. 2B in order thus to couple the car and shaft doors to one another. In this process, the right-hand coupling roller 18 serving as reference element presses the counter element 152 against the support skid 151. The two piezosensors 20 thereupon detect that a mechanical interaction in the form of a force between counter element 152 and reference element 18 overshoots a specific minimum value, which means that counter element and reference element interact with one another in the prescribed measure.

Figures 5A, 5B, 5C, 5D:
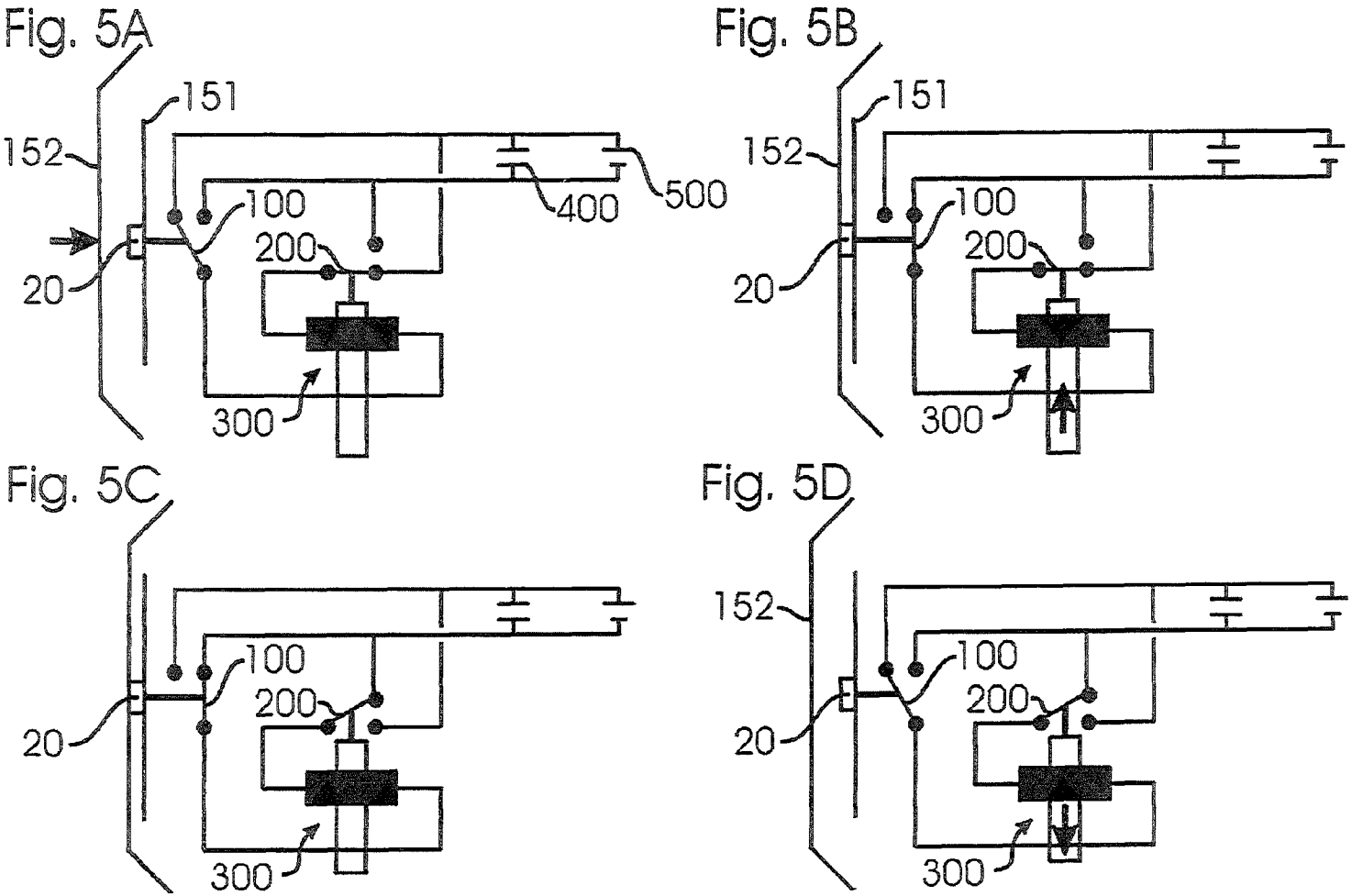
FIGS. 5A-5D show a control device of the locking system from FIG. 1 in the case of transition between various states.

If at least one of the two piezosensors 20 detects such an interaction, an electrical signal is output which switches over a first switch 100 of a control device of the locking system from an absence state (FIG. 5A) into a presence state (FIG. 5B).

At the start of the unlocking, the solenoid 300, shown in FIGS. 1A, 1B, of the locking device 12 is located in a stable locking position (lower position of the magnet armature of the solenoid 300 in FIG. 5) and thus prevents the car door from opening. A second switch 200 is switched into a lock state (FIG. 5A).

As may be seen in FIG. 5B, switching over the first switch 100 into the presence state while the second switch 200 is located in the lock state closes an electrical circuit and connects a current source 500 of a lift controller (not illustrated) to the solenoid 300 in such a way that the latter moves into a stable unlocking position (upper position of the magnet armature of the solenoid in FIG. 5), and thus enables opening of the car door. The locking device is thus supplied with energy for transferral into its unlocked state as long as the first switch is located in the presence state and the second switch in the lock state (FIG. 5B).

As soon as the solenoid 300 assumes its stable unlocking position (FIG. 5C), the second switch 200 is switched into an unlock state such that the electrical circuit is interrupted again. In this unlocked state of the locking device, there is no need for electrical energy to maintain the state, owing to the bistable design of the solenoid.

If the car and shaft doors are subsequently reclosed, and the support skid 151 and the left-hand driver skid 15.2 are subsequently transferred into the decoupling position shown in FIG. 2A by the adjusting elements 17.1, 17.2, the two piezosensors 20 no longer detect an interaction in the prescribed measure, since the coupling roller 18 acting as reference element no longer presses against the counter element 152. Consequently, the electrical signal of the piezosensors is changed, and so the first switch 100 is switched back from the presence state (FIG. 5C) into the absence state (FIG. 5D).

As may be seen in FIG. 5D, switching over the first switch 100 into the absence state while the second switch 200 is located in the unlock state closes another electrical circuit and connects the current source 500 to the solenoid 300 in such a way that it moves into its stable locking position. The locking device is thus supplied with energy for transferral into the locked state as long as the first switch is located in the absence state and the second switch in the unlock state (FIG. 5D).

As soon as the bistable solenoid 300 assumes its stable locking position (FIG. 5A), the second switch 200 is switched into the lock state such that the other electrical circuit is interrupted again. In this locked state, there is thus likewise no need for electrical energy to maintain the state, and the locking system is again located in the state, explained at the beginning with reference to FIG. 5A, with a locked car door, counter element and reference element 152, 18 not interacting with one another.

In order to enable locking and unlocking even in the event of failure of the current source 500, an energy store, for example a capacitor 400, a storage battery or the like is provided in parallel with the current source 500.

Figure 3B:
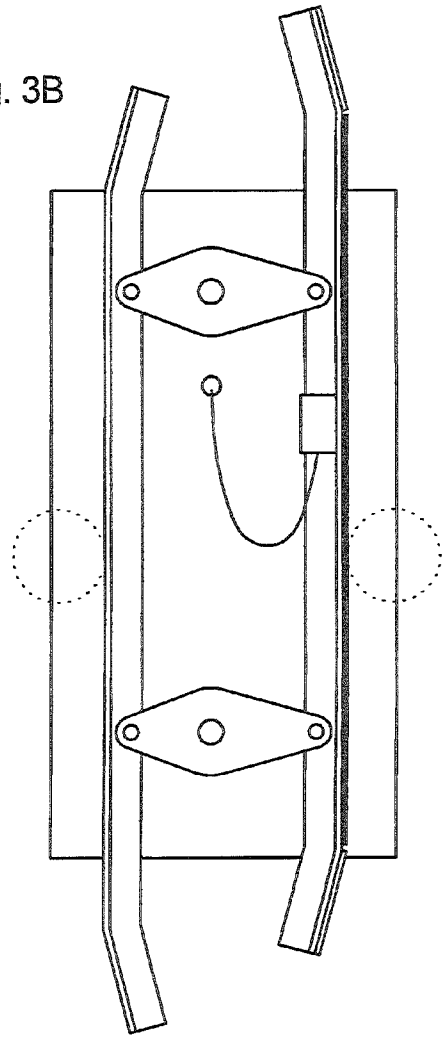
FIGS. 3A, 3B show a modified coupling device of the locking system from FIG. 1.
Figure 3A:
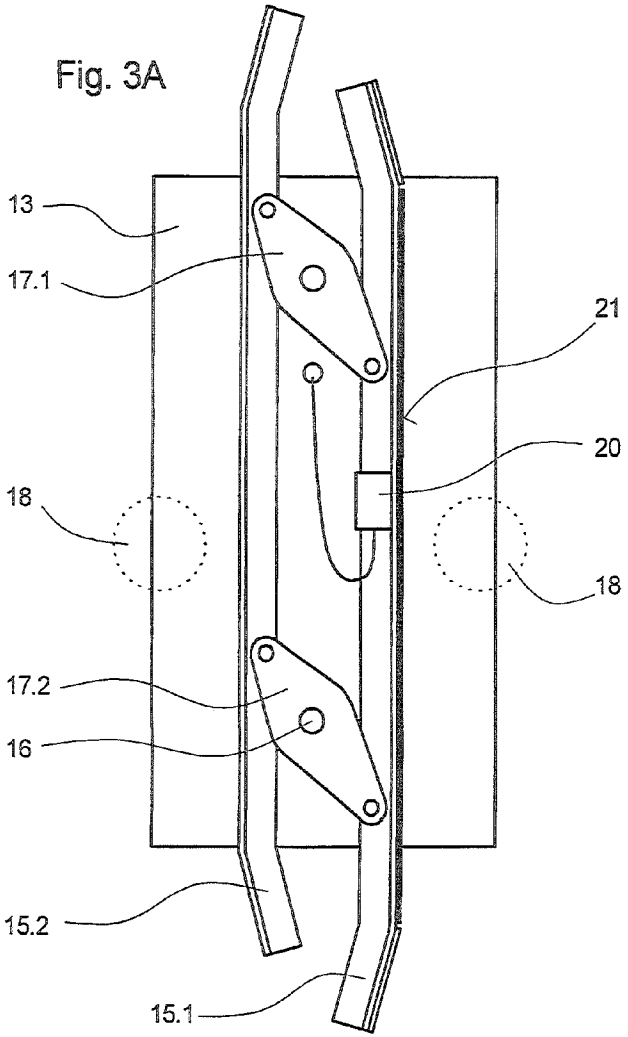

FIGS. 3A, 3B show a modified coupling device of the locking system from FIG. 1. Identical elements are designated by identical reference numerals, and so only the differences from the design explained above are examined below.

In the modified coupling device, the right-hand driver skid 15.1 is also configured in one part and forms the counter element. A force sensor in the form of a diaphragm switch 20 is arranged on the contact surface, facing the reference element, that is to say the right-hand coupling roller 18, of the driver skid such that a sensor surface 21 comes into contact with the right-hand coupling roller 18 when the driver skids 15.1, 15.2 of the coupling device 14 are spread against the coupling rollers 18. When the pressure exerted by the right-hand coupling roller 18 on the sensor surface 21 overshoots a prescribed maximum value, conductive bodies (not illustrated) arranged in the sensor surface 21 between two surface layers touch one another and in so doing make an electrical contact. The diaphragm switch 20 thus functions as the first switch 100 which is explained with reference to FIG. 5 and which is switched into a presence state (closed electrical contact) as long as reference element 18 and counter element 15.1 are interacting with one another in the prescribed measure, that is to say exert sufficient pressure on one another.

By way of example, it is also possible to use as sensor surface 21 diaphragm-type force and pressure sensors in the case of which there is arranged between two metal foils a layer made from electrically conducting foam whose electrical resistance is reduced by compression.

A further example of diaphragm-type force sensors which can be applied according to the invention as sensor surface 21 are force sensors which include metal foils which are arranged in parallel in a diaphragm in a fashion separated by thin elastic plastics. Pressure exerted on the diaphragm varies at least partially the spacings between the metal foils, thus giving rise to a variation in the electrical capacitance of the metal foil arrangement which can be evaluated.

Diaphragm-type force sensors which include a multiplicity of piezoresistive elements are a further example of force and pressure sensors which can be applied in an inventive locking system as sensor surface 21.

Figure 4B:
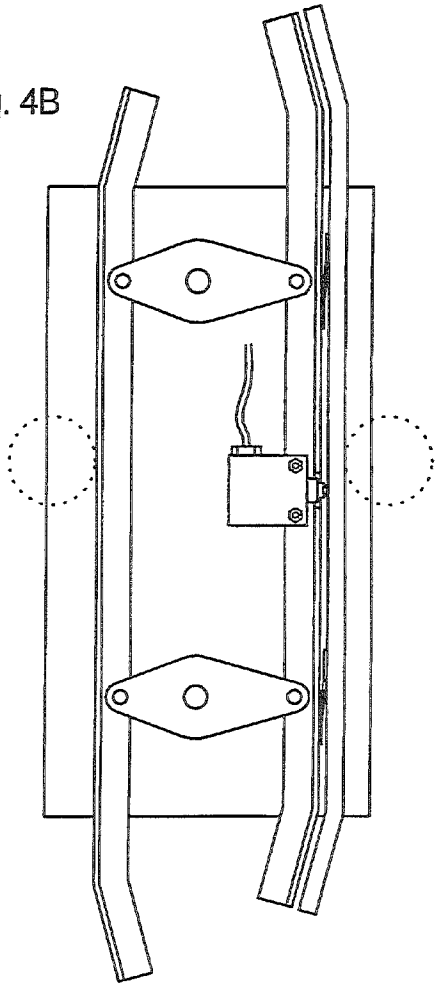
FIGS. 4A, 4B show a further modified coupling device of the locking system from FIG. 1.
Figure 4A:
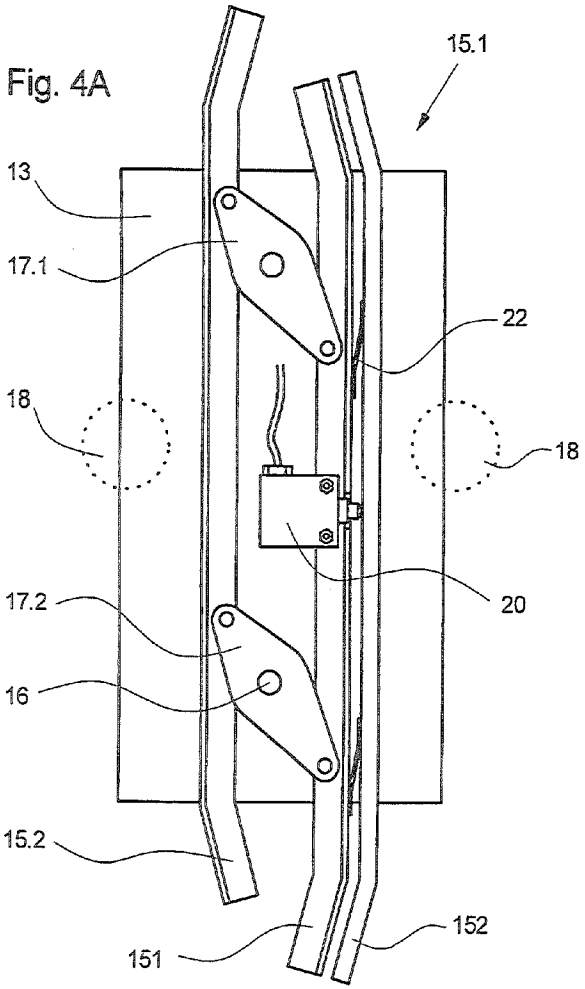

FIGS. 4A, 4B show a further modified coupling device of the locking system from FIG. 1. Identical elements are designated by identical reference numerals, and so only the differences from the designs explained above will be examined below.

In the further modified locking device, the counter element 152 is supported elastically, by means of springs 22, on the support skid 151 of the bipartite right-hand driver skid 15.1. A distance sensor 20, which can operate mechanically (FIG. 4), but also without making contact, for example, optically, inductively or capacitively, (not illustrated), detects the spacing between counter element 152 and support skid 151.

If the driver skids 15.1, 15.2 of the coupling device are spread against the coupling rollers 18, the right-hand coupling roller 18 moves the counter element 152 towards the support skid 151 under elastic deformation of the springs 22, the spacing between counter element 152 and support skid 151 being reduced, and this is detected by the distance sensor 20. If this spacing undershoots a prescribed minimum value, the distance sensor 20 generates an appropriate signal, which has the effect that the first switch 100 explained with reference to FIG. 5 is switched into a presence state, as long as the reference element 18 and the counter element 152 interact with one another in the prescribed measure, that is to say exert a sufficient force on one another.

The invention claimed is:

1. Locking system for a lift door, comprising:

a locking device which in an unlocked state enables opening of the lift door, and in a locked state, which prevents opening of the lift door;

a reference element;

a counter element which is provided for the purpose of entering into interaction with the reference element when at least a condition is fulfilled that the lift car is located in a permissible position relative to a shaft door;

a sensor which outputs an electrical signal when the reference element and the counter element have entered into interaction, and wherein the reference element, the counter element and the sensor are arranged in a coupling device for coupling the car door to the shaft door;

a control device which transfers the locking device from the locked state into the unlocked state as a function of the electrical signal;

wherein the coupling device has a driver skid configured to be moved for coupling purposes against the reference element arranged on the shaft door, and comprises the counter element; and wherein the driver skid comprises a support skid, and the counter element is configured to be moved linearly relative to the support skid by the reference element, the sensor outputting the signal when a spacing between the support skid and the counter element, or a force acting between a contact surface of the support skid and the counter element is detected, which lies in a prescribed range.

2. Locking system according to claim 1, wherein the reference element is arranged on the shaft door.

3. Locking system according to claim 1, wherein a sensor surface of the sensor, by which the sensor detects the interaction, is arranged on a contact surface, opposite the reference element, of the counter element designed as driver skid, the sensor outputting the signal when a spacing between the reference element and the contact surface, or a force acting between the reference element and the contact surface, lies in a prescribed range which outputs the signal when a force exerted on the counter element by the reference element lies in a prescribed range.

4. Locking system according to claim 1, wherein the sensor comprises a force sensor, which outputs the signal when a force exerted on the counter element by the reference element lies in a prescribed range.

5. Locking system according to claim 4, wherein the sensor comprises a piezosensor which outputs the signal when a force exerted on the counter element by the reference element lies in a prescribed range.

6. Locking system according to claim 4, wherein the sensor comprises a force sensor selected from the group consisting of a diaphragm switch, a pressure dependent resistor and a pressure dependent capacitor, wherein the force sensor outputs the signal when a force exerted on the counter element by the reference element lies in a prescribed range.

7. Locking system according to claim 1, wherein the sensor comprises a distance sensor which outputs the signal when a spacing between the counter element and the reference element or another reference element lies in a prescribed range.

8. Locking system according to claim 7, wherein the sensor comprises a distance sensor selected from a group consisting of a mechanical, an inductive, a capacitive, an optical and an acoustic sensor, wherein the distance sensor outputs the signal when a spacing between the counter element and the reference element or another reference element, lies in a prescribed range.

9. Locking system according to claim 7, wherein the sensor comprises a magnetic reed sensor which outputs the signal when a spacing between the counter element and the reference element or another reference element, lies in a prescribed range.

10. Locking system according to claim 7, wherein the distance sensor outputs the signal when a spacing between the counter element and a support skid lies in a prescribed range.

11. Locking system according to claim 7, wherein the reference element and the counter element are not mechanically engaged with the locking device.

12. Locking system according to claim 1, wherein the sensor is at least partially flat.

13. Locking system according to claim 1, wherein a measure of interaction between reference element and counter element is prescribed that the sensor outputs the signal when the interaction between reference element and counter element undershoots or overshoots a prescribed limiting value.

14. Locking system according to claim 1, wherein the locking device has a bistable bolt for locking the lift door.

15. Locking system according to claim 1, wherein the control device comprises an electric switch which is switched over directly or indirectly by the signal output by the sensor.

16. Locking system according to claim 1, wherein the control device can also be actuated by remote control.

17. Lift having a lift car which can be moved in a shaft, at least one car door, at least one shaft door and a locking system according to claim 1.

18. Locking system according to claim 1, wherein the reference element and the counter element are not mechanically engaged with the locking device.

19. Locking system according to claim 1, wherein an entirety of the counter element is configured to be moved linearly relative to the support skid by the reference element.

20. Locking system for a lift door, comprising:

a bistable locking device which in a stable unlocked state enables opening of the lift door, and in a stable locked state prevents opening of the lift door;

a reference element;

a counter element which is provided for entering into interaction with the reference element when at least a condition is fulfilled that the lift car is located in a permissible position relative to a shaft door;

a sensor which outputs an electrical signal when the reference element and the counter element have entered into interaction, and wherein the reference element, the counter element and the sensor are arranged in a coupling device for coupling the car door to the shaft door;

a control device which transfers the locking device from the locked state into the unlocked state as a function of the electrical signal, the control device comprising:

a first switch which is switched into a presence state when the reference element and the counter element have entered into interaction, and into an absence state when said interaction is not present, and a second switch which is switched into a lock state when the locking device is transferred into the locked state, and is switched into an unlock state when the locking device is transferred into the unlocked state;

such that the locking device upon being supplied with energy will transfer into the unlocked state as long as the first switch is in the presence state and the second switch in the lock state, and the locking device upon being supplied with energy will transfer into the locked state as long as the first switch is in the absence state and the second switch in the unlock state;

wherein the coupling device has a driver skid configured to be moved for coupling purposes against the reference element arranged on the shaft door, and comprises the counter element; and wherein the driver skid comprises a support skid, and the counter element is configured to be moved linearly relative to the support skid by the reference element, the sensor outputting the signal when a spacing between the support skid and the counter element, or a force acting between a contact surface of the support skid and the counter element is detected, which lies in a prescribed range.

21. Locking system according to claim 20, wherein an entirety of the counter element is configured to be moved linearly relative to the support skid by the reference element.

22. Locking system for a lift door, comprising:

a locking device which in an unlocked state enables opening of the lift door, and in a locked state, which prevents opening of the lift door;

a reference element;

a counter element which is provided for the purpose of entering into interaction with the reference element when at least a condition is fulfilled that the lift car is located in a permissible position relative to a shaft door;

a sensor which outputs an electrical signal when the reference element and the counter element have entered into interaction, and wherein the reference element, the counter element and the sensor are arranged in a coupling device for coupling the car door to the shaft door;

an actuator configured to transfer the locking device from the locked state into the unlocked state;

wherein the coupling device has a driver skid configured to be moved for coupling purposes against the reference element arranged on the shaft door, and comprises the counter element; and wherein the driver skid comprises a support skid, and the counter element is configured to be moved linearly relative to the support skid by the reference element, the sensor outputting the signal when a spacing between the support skid and the counter element, or a force acting between a contact surface of the support skid and the counter element is detected, which lies in a prescribed range.

23. Locking system according to claim 22, wherein an entirety of the counter element is configured to be moved linearly relative to the support skid by the reference element.

* * * * *